US011639702B2

(12) United States Patent
Kim et al.

(10) Patent No.: US 11,639,702 B2
(45) Date of Patent: May 2, 2023

(54) FUEL EVAPORATION GAS TREATMENT SYSTEM

(71) Applicants: Hyundai Motor Company, Seocho (KR); Kia Corporation, Seoul (KR)

(72) Inventors: Chang Han Kim, Gwangju (KR); Jun Sik Lim, Incheon (KR); Seung Hoon Choi, Seoul (KR); Gil Eon Kang, Suwon-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/643,865

(22) Filed: Dec. 13, 2021

(65) Prior Publication Data

US 2023/0003179 A1 Jan. 5, 2023

(30) Foreign Application Priority Data

Jun. 30, 2021 (KR) ..... 10-2021-0085212

(51) Int. Cl.
*F02M 25/08* (2006.01)

(52) U.S. Cl.
CPC ..... *F02M 25/0836* (2013.01); *F02M 25/089* (2013.01); *F02M 25/0872* (2013.01)

(58) Field of Classification Search
CPC ..... F02M 25/0836; F02M 25/0872; F02M 25/089
See application file for complete search history.

(56) References Cited

U.S. PATENT DOCUMENTS 5,194,075 A * 3/1993 Matsuoka ..... F02M 25/089 96/144
6,247,456 B1 * 6/2001 Everingham ..... F02M 25/0836 123/520
2002/0074059 A1 * 6/2002 Schaefer ..... B60K 15/03519 141/325
2002/0088439 A1 * 7/2002 Distelhoff ..... B60K 15/03504 123/516

(Continued)

FOREIGN PATENT DOCUMENTS

DE 102013016460 A1 * 4/2015 ..... F02M 37/0029
JP 05312114 A * 11/1993

(Continued)

*Primary Examiner* — John M Zaleskas
(74) *Attorney, Agent, or Firm* — McDonnell Boehnen Hulbert & Berghoff LLP

(57) ABSTRACT

Disclosed is a fuel evaporation gas treatment system for a vehicle, which includes a sub-purge system configured such that a fuel evaporation gas adsorbed in a canister is recovered into a fuel tank, the sub-purge system including a recovery port formed in the canister, a recovery line connected to the recovery port, an ejector provided to receive fuel delivered by a fuel pump, to suck the fuel evaporation gas from the canister through the recovery line and the recovery port upon generation of negative pressure, and to discharge the fuel evaporation gas to the fuel tank, a driving fluid hose connecting the discharge port of the fuel pump to the driving inlet of the ejector to supply the fuel to the ejector, and a recovery control valve for opening and closing a fuel passage so that the fuel is selectively supplied to the ejector.

13 Claims, 11 Drawing Sheets

(56) References Cited

U.S. PATENT DOCUMENTS

2003/0205272 A1* 11/2003 Benjey ..... F16K 15/148 137/202
2005/0133097 A1* 6/2005 Mitani ..... F02M 37/10 137/565.22
2007/0044549 A1* 3/2007 Yoshioka ..... F02M 25/0809 73/114.38
2007/0151610 A1* 7/2007 Hatano ..... F02M 25/089 137/574
2010/0288021 A1* 11/2010 Makino ..... F02M 25/0836 73/40.7
2010/0288241 A1* 11/2010 Makino ..... F02M 37/10 123/521
2010/0288242 A1* 11/2010 Makino ..... F02M 25/0836 123/521
2010/0294251 A1* 11/2010 Makino ..... F02M 37/20 123/519
2011/0146491 A1* 6/2011 Suefuji ..... B01D 63/046 96/8
2011/0186020 A1* 8/2011 Makino ..... F02M 33/02 123/521
2011/0214646 A1* 9/2011 Makino ..... B01D 50/00 96/108
2011/0247595 A1* 10/2011 Ogita ..... F02M 33/02 123/521
2011/0308302 A1* 12/2011 Makino ..... F02M 25/0836 73/40.7
2012/0085325 A1* 4/2012 Makino ..... B01D 53/04 123/521
2013/0160877 A1* 6/2013 Walter ..... F02M 37/025 137/565.22
2014/0134007 A1* 5/2014 Koith ..... F04F 5/461 417/191
2015/0240764 A1* 8/2015 Walter ..... B60K 15/03504 417/76
2015/0337865 A1* 11/2015 Walter ..... F04F 5/24 417/151
2018/0245545 A1* 8/2018 Benjey ..... F02D 41/0032
2018/0298850 A1* 10/2018 Villaire ..... B60K 15/03504
2019/0178263 A1* 6/2019 Walter ..... F04F 5/24
2020/0217276 A1* 7/2020 Nakagawa ..... F02M 25/0854
2021/0148309 A1* 5/2021 Villaire ..... F02M 25/0872

FOREIGN PATENT DOCUMENTS

JP 2000073898 A * 3/2000
JP 2000170609 A * 6/2000
JP 2002235608 A * 8/2002
JP 2004092510 A * 3/2004
JP 2004324488 A * 11/2004
JP 2004353600 A * 12/2004
JP 2005127282 A * 5/2005
JP 2009198444 A * 9/2009
JP 2009198450 A * 9/2009
JP 2009204322 A * 9/2009 ..... F02D 33/02

* cited by examiner

< When power is turned off >

< When power is turned on >

< When turbocharger is not operated >

< When turbocharger is operated >

FUEL EVAPORATION GAS TREATMENT SYSTEM

CROSS-REFERENCE TO RELATED APPLICATION

This application claims under 35 U.S.C. § 119(a) the benefit of priority from Korean Patent Application No. 10-2021-0085212, filed on Jun. 30, 2021, the entire contents of which are incorporated herein by reference.

TECHNICAL FIELD

The present disclosure relates to a fuel evaporation gas treatment system for a vehicle, and more particularly to a fuel evaporation gas treatment system for a vehicle capable of solving problems such as failure to satisfy evaporation gas regulations and generation of a fuel smell due to the inability to purge a fuel evaporation gas when a turbocharger is operated in a vehicle equipped with a turbocharger.

BACKGROUND

In general, the fuel system for a vehicle includes a fuel tank for storing fuel, a fuel pump module for supplying the fuel stored in the fuel tank to an engine, a fuel filter for removing foreign substances from the fuel supplied to the engine, and a fuel line for transferring fuel, including a fuel supply line and a fuel return line.

In addition, the fuel system for a vehicle further includes a fuel evaporation gas treatment system for treating and controlling fuel evaporation gas (HC gas) generated in the fuel tank. FIG. 1 schematically shows the configuration of a fuel evaporation gas treatment system. In FIG. 1, reference numeral '1' denotes a fuel tank, reference numeral '2' denotes a fuel pump module installed in the fuel tank 1, and reference numeral '3' denotes a filler neck assembly for injecting fuel into the fuel tank.

As shown therein, the fuel evaporation gas treatment system includes a canister 10 for adsorbing and collecting a fuel evaporation gas generated in the fuel tank 1, an air filter 13 for removing foreign substances from the air sucked into the canister 10, a canister close valve 12 for opening and closing a pipe (an ambient atmosphere line) 11 between the canister 10 and the air filter 13, and a purge control solenoid valve (PCSV) 15 for opening and closing a pipe (a purge line) 14 between the canister 10 and the engine intake system 4 or adjusting the extent of opening of the pipe.

Describing the configuration thereof in more detail, a gas resulting from evaporation of fuel, that is, a fuel evaporation gas including fuel components such as hydrocarbon (HC) and the like, is generated in the fuel tank 1. Accordingly, in order to prevent air pollution due to the fuel evaporation gas generated in the fuel tank 1, a canister 10 for collecting and storing the fuel evaporation gas from the fuel tank is installed in the vehicle.

The canister 10 is configured such that a case thereof is filled with an adsorbent material capable of adsorbing the fuel evaporation gas moved from the fuel tank 1, and the adsorbent material that is widely used therefor is activated carbon. The activated carbon functions to adsorb fuel components, that is, hydrocarbons (HC) or the like, in the fuel evaporation gas introduced into the case of the canister 10.

The canister 10 adsorbs the fuel evaporation gas to the adsorbent material in the state in which the engine is stopped. Also, when the engine is run, the canister 10 desorbs the fuel evaporation gas adsorbed to the adsorbent material using the pressure of the air sucked from the outside (ambient atmosphere) to thus supply the desorbed gas together with the air to the engine intake system.

The operation of sucking the collected fuel evaporation gas from the canister 10 into the engine is called a purge operation, and the gas that is sucked from the canister into the engine is called purge gas. The purge gas may be a gas in which fuel components such as hydrocarbons (HC) or the like desorbed from the adsorbent material of the canister and air are mixed.

The PCSV 15 for controlling a purge operation is installed in the purge line 14, which is the pipe connecting the canister 10 and the engine intake system 4. The PCSV 15 is opened upon a purge operation while the engine is running. The fuel evaporation gas generated in the fuel tank 1 is collected in the canister 10, purged to the engine intake system 4 through the PCSV 15 in an open state while the engine is running, and then burned in the engine.

The PCSV 15 is controlled by a control unit (not shown), for example, an engine control unit (ECU). The control unit controls opening or closing of the PCSV 15 (turns on/off the purge operation) or the extent of opening (gas flow rate) of the PCSV depending on the conditions under which the vehicle is being driven in order to control the fuel evaporation gas.

More specifically, the canister 10 includes a case filled with an adsorbent material (e.g. activated carbon). The case includes a loading port 10*a* connected to the fuel tank 1 and configured to introduce the fuel evaporation gas from the fuel tank, a purge port 10*b* connected to the engine intake system 4 and configured to supply the fuel evaporation gas to the engine side, and an ambient atmosphere port 10*c* connected to the air filter (canister filter) 13 and configured to suck air from the ambient atmosphere.

The loading port 10*a* of the canister 10 is connected to the fuel tank 1 through a loading line 16, and the purge port 10*b* of the canister is connected to the engine intake system 4 through the purge line 14. An ambient atmosphere line (vent line) 11, which is the pipe connected to the air filter 13, is connected to the ambient atmosphere port 10*c* of the canister.

A partition wall (not shown) is provided in the inner space of the case in order to partition a space in which the ambient atmosphere port 10*c* is located from a space in which the purge port 10*b* and the loading port 10*a* are located. Accordingly, while the fuel evaporation gas introduced from the fuel tank 1 through the loading port 10*a* passes along the inner space partitioned by the partition wall, fuel components, that is, hydrocarbons (HC), are adsorbed onto the adsorbent material.

Also, when the PCSV 15 is opened by the control unit while the engine is running and the suction pressure, namely the engine negative pressure, acts on the inner space of the canister 10 through the purge port 10*b* from the engine intake system 4, air is sucked through the air filter 13 and through the ambient atmosphere port 10*c*, and the gas desorbed from the adsorbent material by the air is discharged through the purge port 10*b* and sucked into the engine intake system 4.

In this way, for the purge operation in which the fuel component such as hydrocarbon or the like is desorbed from the adsorbent material in the canister 10 and is then sucked into the engine intake system 4, the engine negative pressure has to act on the canister 10 through the purge line 14 and the purge port 10*b*.

Meanwhile, even when the vehicle is equipped with the fuel evaporation gas treatment system, a problem in which a fuel smell occurs in the vehicle occurs. Specifically, when the vehicle is stopped, the fuel evaporation gas (HC gas) is released to the outside, so the driver or passenger may detect a fuel smell. Such a fuel smell mainly occurs under hot and high conditions, and in particular, the driver or passenger may easily smell the fuel when the vehicle is stopped.

Under hot conditions in which the outdoor temperature is high, the transfer of external heat such as engine heat, exhaust heat, geothermal heat, etc. increases, thereby increasing the internal temperature of the fuel tank, and vapor pressure decreases under high conditions. Accordingly, the amount of fuel evaporation gas (HC) that is generated increases in the fuel tank, and when the amount of fuel evaporation gas that is generated increases, the collection capacity of the canister is exceeded, and thus the fuel evaporation gas may be discharged to the outside. Ultimately, the driver or the passenger may smell the fuel evaporation gas (fuel smell) released to the outside when the vehicle is stopped.

Moreover, in a vehicle equipped with a turbocharger, when the turbocharger is operated (supercharged), positive pressure, rather than negative pressure, is formed in the engine intake system, so the suction of fuel evaporation gas by the negative pressure does not occur, making it impossible to purge the fuel evaporation gas collected in the canister. As described above, when the fuel evaporation gas is not consumed in the engine due to impossibility of purging, the amount of the fuel evaporation gas present in the fuel tank may increase, and the likelihood of the amount of the fuel evaporation gas exceeding the collection capacity in the canister may increase.

Hence, the vehicle may fail to satisfy evaporation gas regulations under hot weather conditions with a high outdoor temperature, and a fuel smell may occur in the vehicle due to the release of the fuel evaporation gas to the outside. Accordingly, there is a need for a technology capable of alleviating problems due to the generation of the fuel smell.

SUMMARY

Therefore, the present disclosure has been made keeping in mind the problems encountered in the related art, and an objective of the present disclosure is to provide a fuel evaporation gas treatment system for a vehicle capable of solving problems such as failure to satisfy evaporation gas regulations and generation of a fuel smell due to the inability to purge a fuel evaporation gas when a turbocharger is operated in a vehicle equipped with a turbocharger.

The objectives of the present disclosure are not limited to the foregoing, and objectives not mentioned herein will be able to be clearly understood from the following description by those of ordinary skill in the art to which the present disclosure belongs (hereinafter referred to as 'person of ordinary skill').

In order to accomplish the above objective, an embodiment of the present disclosure provides a fuel evaporation gas treatment system including a sub-purge system configured such that a fuel evaporation gas adsorbed in a canister is recovered into a fuel tank, the sub-purge system including a recovery port formed in the canister, a recovery line connected to the recovery port, an ejector provided to receive fuel delivered by a fuel pump as a driving fluid, to suck a fuel evaporation gas collected in the canister through the recovery line and the recovery port when negative pressure is generated by the driving fluid, and to discharge the fuel evaporation gas to the fuel tank, a driving fluid hose connecting the discharge port of the fuel pump to the driving inlet of the ejector to supply fuel delivered by the fuel pump as a driving fluid to the ejector, and a recovery control valve for opening and closing a fuel passage through which the fuel is supplied to the ejector so that the fuel delivered by the fuel pump is selectively supplied to the ejector.

BRIEF DESCRIPTION OF THE DRAWINGS

The above and other features of the present disclosure will now be described in detail with reference to certain exemplary embodiments thereof illustrated in the accompanying drawings, which are given hereinbelow by way of illustration only, and thus are not limitative of the present disclosure, and wherein.

DETAILED DESCRIPTION

Figure 1:
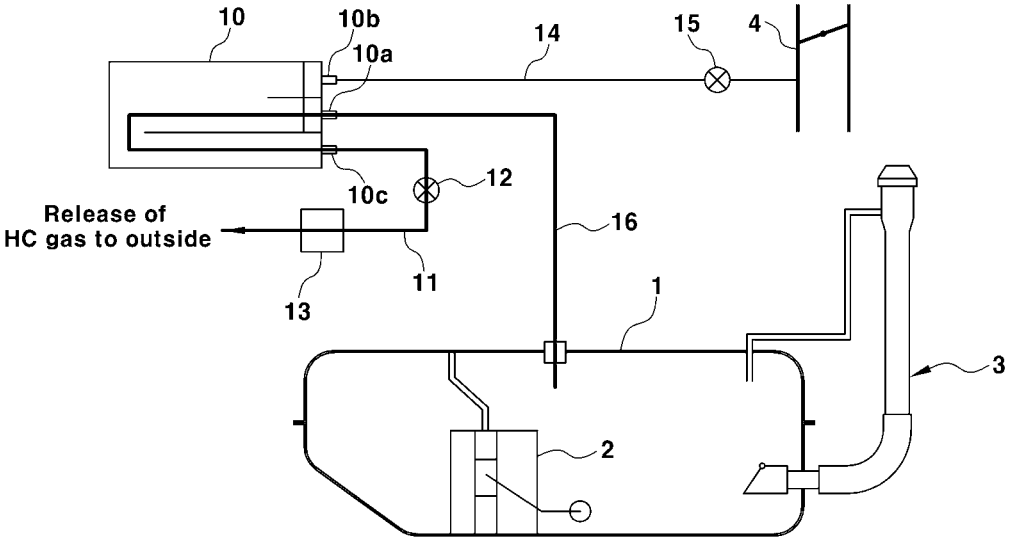
FIG. 1 schematically shows a conventional fuel system.

Specific structural or functional descriptions presented in the embodiments of the present disclosure are only illustrated for the purpose of describing the embodiments according to the concept of the present disclosure, and embodiments according to the concept of the present disclosure may be implemented in various forms. In addition, the present disclosure should not be construed as being limited to the embodiments described herein, but should be understood to include all modifications, equivalents, and substitutes included in the spirit and scope of the present disclosure.

It will be understood that, although the terms "first," "second," etc. may be used herein to describe various elements, these elements are not limited by these terms. These terms are only used to distinguish one element from another element. For instance, a first element discussed below could be termed a second element without departing from the scope of the present disclosure. Similarly, the second element could also be termed the first element.

It will be understood that when an element is referred to as being "joined" or "connected" to another element, it can be directly joined or connected to the other element, or intervening elements may be present therebetween. In contrast, it should be understood that when an element is referred to as being "directly connected" or "directly coupled" to another element, there are no intervening elements present. Other expressions that explain the relationships between elements, such as "between," "directly between," "adjacent to," or "directly adjacent to," should be construed in the same way.

Throughout the specification, the same reference numerals will refer to the same or like elements. The terminology used herein is for the purpose of describing the embodiments, and is not intended to limit the present disclosure. As used herein, the singular forms are intended to include the plural forms as well, unless the context clearly indicates otherwise. It will be further understood that the terms "comprise", "include", "have", etc., when used in this specification specify the presence of stated elements, steps, operations, and/or devices, but do not preclude the presence or addition of one or more other elements, steps, operations, and/or devices.

Hereinafter, a detailed description will be given of embodiments of the present disclosure with reference to the appended drawings.

The present disclosure is intended to provide a fuel evaporation gas treatment system capable of solving problems such as failure to satisfy evaporation gas regulations and generation of a fuel smell due to the inability to purge a fuel evaporation gas when a turbocharger is operated in a vehicle equipped with a turbocharger.

In order to solve the above problems, the fuel evaporation gas treatment system according to the present disclosure includes a sub-purge system configured such that a fuel evaporation gas (including fuel components such as hydrocarbons or the like) may be recovered from the canister to the inside of the fuel tank during operation of the turbocharger, and may be purged.

Figure 2:
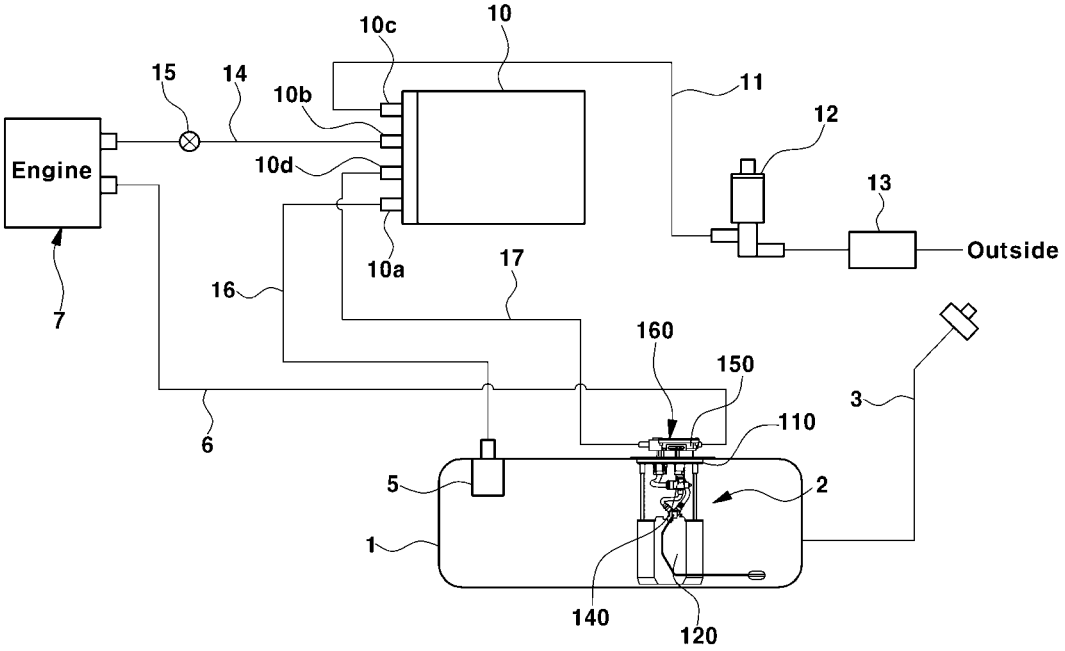
PRIOR ART FIG. 2
FIG. 2 shows the configuration of a fuel evaporation gas treatment system according to an embodiment of the present disclosure.

FIG. 2 shows the configuration of a fuel evaporation gas treatment system according to an embodiment of the present disclosure, particularly the configuration of a fuel evaporation gas treatment system including a sub-purge system and the configuration of a fuel system. First, the fuel system for a vehicle includes a fuel tank 1 for storing fuel, a fuel pump module 2 for supplying the fuel stored in the fuel tank 1 to an engine 7, and a fuel supply line 6 connected to supply fuel from the fuel pump module 2 to the engine 7.

In addition, the fuel system for a vehicle further includes a fuel evaporation gas treatment system for treating and controlling the fuel evaporation gas (HC gas) generated in the fuel tank 1. The fuel evaporation gas treatment system includes a canister 10 for adsorbing and collecting a fuel evaporation gas generated in the fuel tank 1, an air filter 13 for removing foreign substances from the air sucked into the canister 10, a canister close valve 12 for opening and closing a pipe (an ambient atmosphere line) 11 between the canister 10 and the air filter 13, and a purge control solenoid valve (PCSV) 15 for opening and closing a pipe (a purge line) 14 between the canister 10 and the intake system of the engine 7 or adjusting the extent of opening of the pipe.

The canister 10 includes a case filled with an adsorbent material (e.g. activated carbon). The case includes a loading port 10*a* connected to the fuel tank 1 to introduce the fuel evaporation gas from the fuel tank, a purge port 10*b* connected to the engine intake system 4 (FIG. 1) of the engine 7 to supply the fuel evaporation gas to the engine side, and an ambient atmosphere port 10*c* connected to the air filter (canister filter) 13 to suck air from the ambient atmosphere.

Moreover, in the present disclosure, the case of the canister 10 is further provided with a recovery port 10*d*, and the recovery port 10*d* will be described again when the sub-purge system is described later.

The loading port 10*a* of the canister 10 is connected to the fuel tank 1 through a loading line 16, and the purge port 10*b* of the canister 10 is connected to the intake system of the engine 7 through a purge line 14. The ambient atmosphere line (vent line) 11, which is the pipe connected to the air filter 13, is connected to the ambient atmosphere port 10*c* of the canister 10.

A partition wall (not shown) is provided in the inner space of the case in order to partition a space in which the ambient atmosphere port 10*c* is located from a space in which the purge port 10*b* and the loading port 10*a* are located. The fuel evaporation gas introduced through the loading port 10*a* from the fuel tank 1 sequentially passes through the inner space partitioned by the partition wall. Here, the hydrocarbons, which are fuel components, are adsorbed to the adsorbent material.

Also, when the PCSV 15 is opened by the control unit (which may be a pump control unit) while the engine 7 is running and thus the suction pressure, namely the engine negative pressure, acts on the inner space of the canister 10 from the intake system of the engine 7 through the purge port 10*b*, air is sucked through the air filter 13 and the ambient atmosphere port 10*c*, and the fuel component is desorbed from the adsorbent material of the canister 10 by the sucked air. Moreover, the gas including the fuel component desorbed from the adsorbent material is discharged through the purge port 10*b* and is sucked into the intake system of the engine 7.

In FIG. 2, reference numeral '3' denotes a filler neck assembly for injecting fuel into the fuel tank 1. In FIG. 2, reference numeral '5' denotes a valve installed in the fuel tank 1 to which the loading line 16 is connected, which may be a typical roll-over valve.

Meanwhile, the fuel evaporation gas treatment system according to an embodiment of the present disclosure further includes a sub-purge system capable of recovering the collected fuel evaporation gas from the canister into the fuel tank and purging the fuel evaporation gas under predetermined driving conditions for a vehicle (e.g. conditions for operation of a turbocharger).

The fuel evaporation gas treatment system including the sub-purge system may be applied to a vehicle equipped with a turbocharger. Furthermore, the fuel evaporation gas treatment system including the sub-purge system is capable of solving problems such as failure to satisfy evaporation gas regulations and generation of a fuel smell, which conventionally occur due to impossibility of purging when the turbocharger is operated, as described below.

In an embodiment of the present disclosure, the sub-purge system includes a recovery port 10*d* provided at one side of the case of the canister 10, an ejector 140 connected to the recovery port 10*d* through a recovery line 17 and configured such that the fuel delivered by the fuel pump 120 is received as a driving fluid and the fuel evaporation gas collected in the canister 10 is sucked through the recovery line 17 and is then discharged into the fuel tank during operation thereof, and a recovery control valve 150 configured such that the fuel, serving as a driving fluid, delivered by the fuel pump 120 is selectively supplied or not supplied to the ejector 140.

Figure 3:
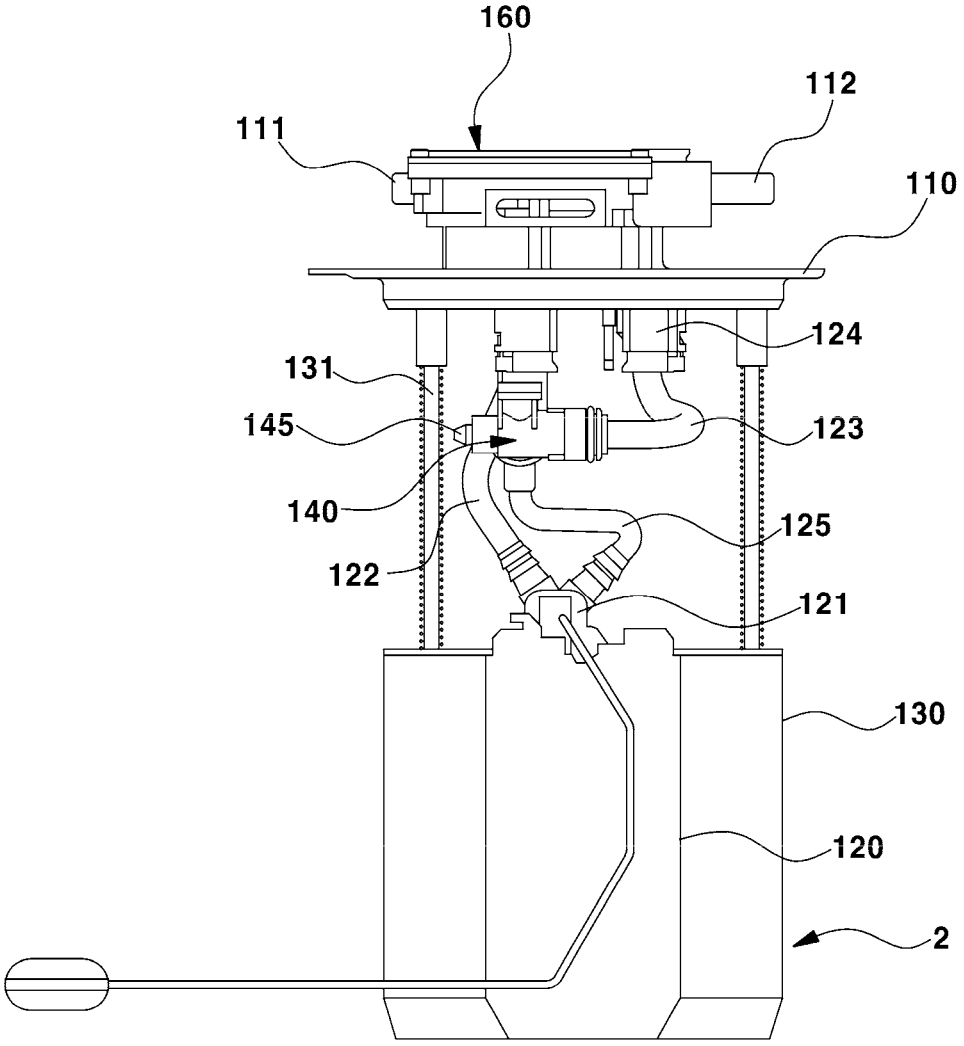
FIG. 3 shows a fuel pump module provided with the ejector of the fuel evaporation gas treatment system according to an embodiment of the present disclosure.
Figure 4:
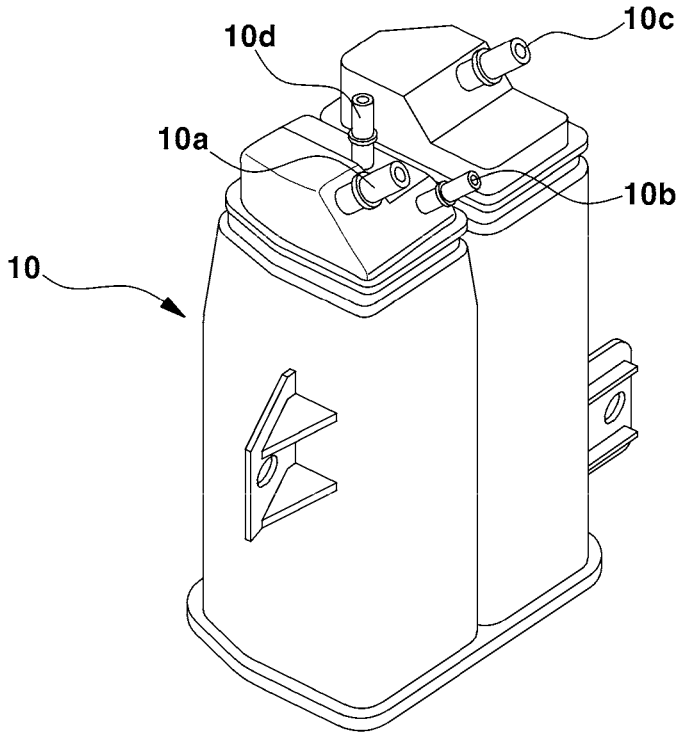
FIG. 4 is a perspective view showing the canister of the fuel evaporation gas treatment system according to an embodiment of the present disclosure.

FIG. 3 is a perspective view showing a fuel pump module provided with the ejector of the fuel evaporation gas treatment system according to an embodiment of the present disclosure, and FIG. 4 is a perspective view showing the canister of the fuel evaporation gas treatment system according to an embodiment of the present disclosure.

With reference to FIG. 3, the fuel pump module 2 includes a fuel pump 120 for sucking and delivering fuel charged in the fuel tank 1 (FIG. 2) while the impeller mounted on the motor shaft rotates during operation of the pump motor. The fuel pump 120 may be fixedly joined to the inside of a reservoir cup 130. Also, the reservoir cup 130 is connected to a fuel pump plate 110 at the upper side via a support bar 131.

The fuel pump plate 110 is mounted over the opening in the fuel tank 1 to seal the inside of the fuel tank, and serves to support and fix the fuel pump 120 and the reservoir cup 130 inserted into the fuel tank through the support bar 131 in the state of being fixedly mounted over the opening in the fuel tank 1.

Also, in the fuel pump module 2, a fuel hose 122 is connected to the discharge port of the fuel pump 120, and the fuel hose 122 is connected to the inner surface (the lower surface) of the fuel pump plate 110 inside the fuel tank 1. Here, a through-hole is formed in the fuel pump plate 110, and the fuel hose 122 is connected to communicate with a fuel supply port 111 (FIG. 6) formed in the outer surface (the upper surface) of the fuel pump plate 110 via the through-hole.

Also, a fuel supply line 6 (FIG. 2) is connected to the fuel supply port 111, and the fuel supply line 6 is connected to the engine 7 (FIG. 2). Accordingly, when the fuel pump 120 is operated, the fuel sucked into the reservoir cup 130 by the fuel pump 120 is discharged through the discharge port of the fuel pump 120 and is then pumped into the engine 7 along the pathway of the fuel hose 122, the fuel supply port 111, and the fuel supply line 6.

Also, one end of a driving fluid hose 125 is connected to the discharge port of the fuel pump 120, and one end of the driving fluid hose 125 is connected to the discharge port of the fuel pump 120 via a 3-way connector 121. Here, both the fuel hose 122 and the driving fluid hose 125 may be connected to the discharge port of the fuel pump 120 via the 3-way connector 121. Specifically, the inlet of the 3-way connector 121 is connected to the discharge port of the fuel pump 120, the fuel hose 122 is connected to one of two outlets of the 3-way connector 121, and the driving fluid hose 125 is connected to the remaining outlet of the 3-way connector 121. Alternatively, the driving fluid hose 125 may be a hose that branches from the fuel hose 122.

The remaining end of the driving fluid hose 125 is connected to the driving inlet 143 (FIG. 5) of the ejector 140. Accordingly, when the fuel pump 120 is operated, some of the fuel discharged through the discharge port of the fuel pump 120 may be supplied as a driving fluid to the driving inlet 143 of the ejector 140 through the driving fluid hose 125.

Figure 5:
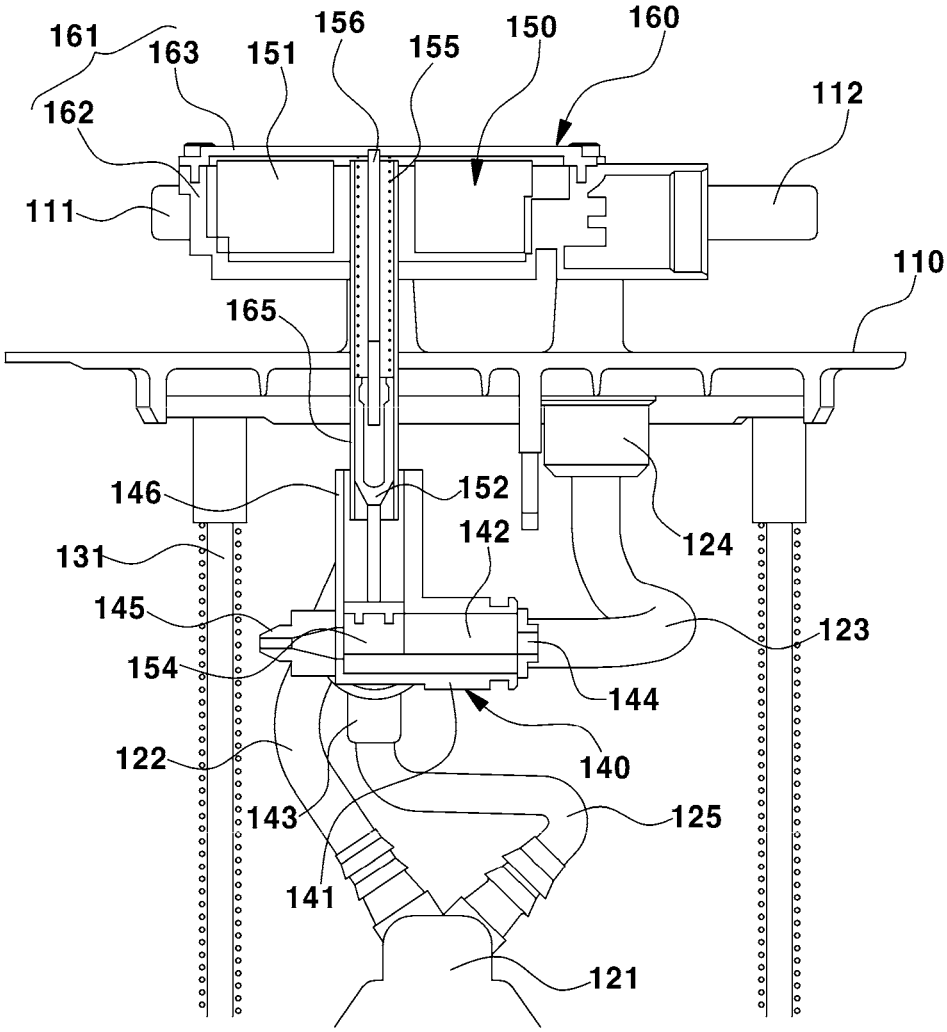
FIG. 5 is a cross-sectional view showing the configuration of an ejector and a recovery control valve in the fuel evaporation gas treatment system according to an embodiment of the present disclosure.

FIG. 5 is a cross-sectional view showing the configuration of the ejector 140 and the recovery control valve 150 installed in the fuel pump module 2 in the fuel evaporation gas treatment system according to an embodiment of the present disclosure. In order to show the inner configuration of the recovery control valve 150, the housing 141 of the ejector 140 in which the recovery control valve is installed and the housing 161 of the pump control unit 160 are shown in cross section.

Figure 6:
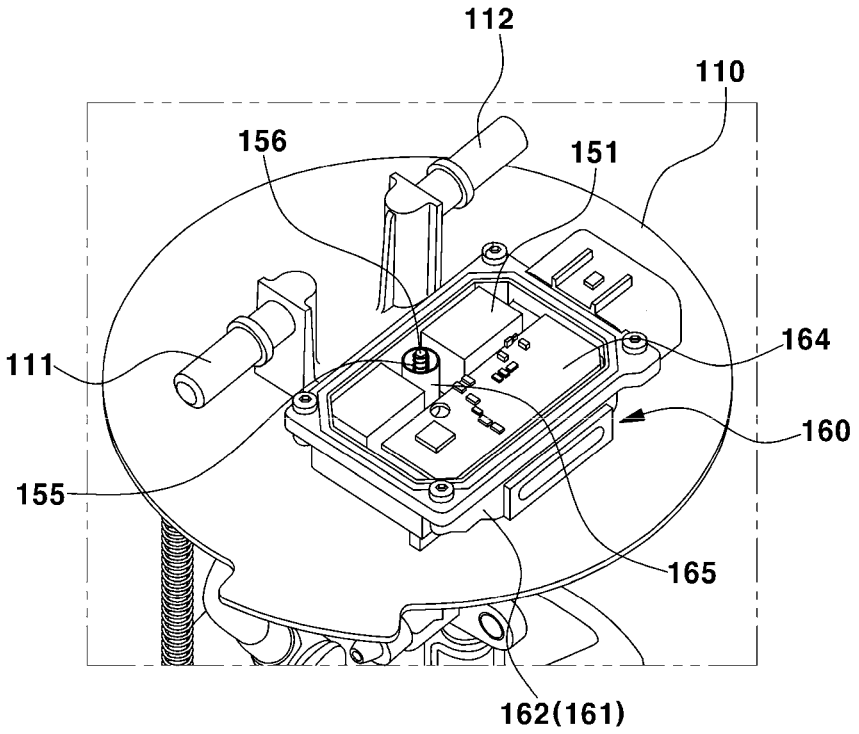
FIG. 6 is a perspective view showing a pump control unit provided with the solenoid of the fuel evaporation gas treatment system according to an embodiment of the present disclosure.

FIG. 6 is a perspective view showing the fuel pump plate 110 provided with the solenoid 151 of the recovery control valve 150 of the fuel evaporation gas treatment system according to an embodiment of the present disclosure. In FIG. 6, a cover 163 (FIG. 5) installed on the upper surface of the housing body to seal the inner space of the housing body 162 in the housing 161 of the pump control unit 160 is not shown. As shown in the drawing, the pump control unit 160 is integrally installed to the fuel pump plate 110 of the fuel pump module 2.

With reference to FIGS. 2 and 6, the fuel supply port 111 and the suction port 112 are integrally formed on the outer surface (the upper surface) of the fuel pump plate 110. The fuel supply line 6 for supplying fuel to the engine 7 is connected to the fuel supply port 111, and the recovery line 17 for sucking the fuel evaporation gas collected in the canister 10 and recovering the same to the fuel tank 1 is connected to the suction port 112.

In the present disclosure, the ejector 140 generates negative pressure using the fuel delivered by the fuel pump 120 as a driving fluid, and the negative pressure thus generated is used as a power source for purging the fuel evaporation gas in the canister 10. The ejector 140 is installed inside the fuel tank 1, and may be fixedly installed to the fuel pump module 2 even inside the fuel tank 1. Also, the ejector 140 is provided to eject and discharge the fuel used as the driving fluid and the fuel evaporation gas purged from the canister 10 into the fuel tank 1 through a nozzle 145.

Figure 7:
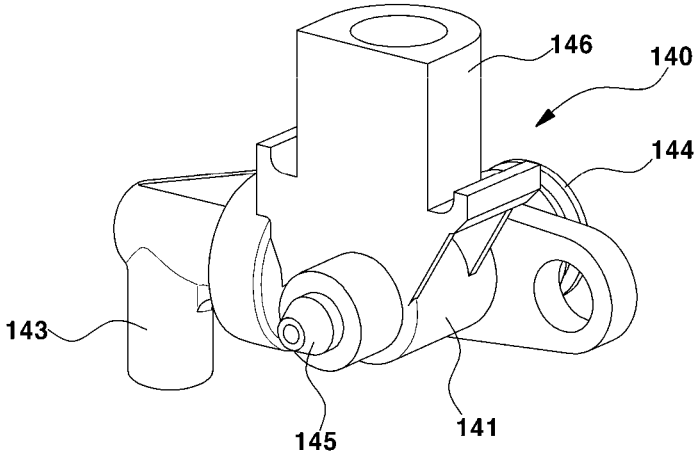
FIG. 7 is a perspective view showing the ejector of a sub-purge system in the fuel evaporation gas treatment system according to an embodiment of the present disclosure.

FIG. 7 is a perspective view showing the ejector of the sub-purge system in the fuel evaporation gas treatment system according to an embodiment of the present disclosure. Here, the ejector 140 may include a housing 141 having an inner passage 142 (FIG. 5), a driving inlet 143 formed in the housing 141 and connected with the driving fluid hose 125 (FIG. 5) to supply fuel delivered through the driving fluid hose 125 from the fuel pump 120 as a driving fluid, a suction inlet 144 formed in the housing 141 and into which the fuel evaporation gas (HC gas) desorbed from the adsorbent material of the canister 10 as a suction fluid is sucked, and a nozzle 145 which is formed in the housing 141 and discharges a mixture of the fuel that is supplied through the driving inlet 143 and is then passed through the inner passage 142 of the housing 141 and the fuel evaporation gas sucked into the inner passage 142 of the housing 141 through the suction inlet 144.

In the ejector 140, when the fuel discharged from the fuel pump 120 is supplied to the inner passage 142 of the ejector 140 through the driving fluid hose 125, the supplied fuel passes through the inner passage 142 of the ejector 140 at a high speed. Also, negative pressure is generated in the inner passage 142 of the ejector 140 while the fuel passes through the inner passage 142 of the ejector 140 at a high speed.

Ultimately, the negative pressure generated in the inner passage 142 of the ejector 140 enables the fuel evaporation gas collected in the canister 10 to be sucked into the inner passage 142 of the ejector 140 through the recovery port 10*d*, the recovery line 17, the suction port 112, the suction hose 123, the check valve 124, and the suction inlet 144 of the ejector 140. The fuel evaporation gas thus sucked passes through the inner passage 142 of the ejector 140 together with the fuel supplied as a driving fluid to the ejector 140, and is then discharged into the fuel tank 1 through the nozzle 145.

The suction inlet 144 of the ejector 140 is connected to the suction port 112 provided in the fuel pump plate 110 through the suction hose 123. Also, the recovery line 17 (FIG. 2) is connected to the suction port 112 of the fuel pump plate 110, and the recovery line 17 is connected to the recovery port 10*d* of the canister 10, as described above.

The nozzle 145 corresponds to an outlet through which the fuel as the driving fluid and the fuel evaporation gas as the suction fluid are discharged in a mixed state from the housing 141, and is provided to eject the fuel and the fuel evaporation gas into the fuel tank 1.

The suction port 112 is installed on the outer surface (the upper surface) of the fuel pump plate 110, and the inner passage 142 of the suction port 112 communicates with a through-hole that perforates the fuel pump plate 110. Here, a check valve 124 is installed to the through-hole in the inner surface (the lower surface) of the fuel pump plate 110 to communicate with the suction port, and the suction hose 123 may be connected to the check valve 124.

The check valve 124 is installed to the suction hose 123 to prevent the fuel supplied into the ejector 140 by the fuel pump 120 from flowing toward the canister 10 through the suction hose 123 and to enable only the fuel evaporation gas in the canister 10 to be sucked into the inner passage 142 of the ejector 140 by the negative pressure inside the ejector 140.

In an embodiment of the present disclosure, the recovery control valve 150 may be an electromagnetic valve whose opening/closing operation is controlled in response to a control signal of the pump control unit 160. Also, the recovery control valve 150 is a valve configured such that the driving fluid, that is, the fuel delivered along the driving fluid hose 125 by the fuel pump 120, is selectively supplied or not supplied to the inner passage 142 of the ejector 140. The recovery control valve 150 may be a solenoid valve configured to open or close the inlet 143 and the inner passage of the ejector 140 using a valve body 154 integrally installed to a plunger 152 by moving the plunger 152 back and forth through control of current supply to the solenoid 151 or interruption of the current supply.

Here, the fuel passage may be the inner passage 142 provided in the housing 141 of the ejector 140. More specifically, the fuel passage may be the inner passage 142 that connects the suction inlet 144 and the nozzle 145 inside the housing 141 of the ejector 140. As such, the lower end of the plunger 152 and the valve body 154 installed at the lower end of the plunger 152 are joined to thereby be inserted into the housing 141 of the ejector 140.

In an embodiment of the present disclosure, a connection passage portion 146 may be formed to extend long in a predetermined direction, for example upwards, on the housing 141 of the ejector 140, and the valve body 154 is located in the connection passage portion 146 to be able to slide along the inner surface thereof in the state in which the plunger 152 is inserted therein. Also, the connection passage portion 146 of the ejector 140 is joined to a guide passage portion 165, formed to extend long downwards from the inner surface (the lower surface) of the fuel pump plate 110.

Also, both the connection passage portion 146 and the guide passage portion 165 may be provided in a pipe form, and may be joined to each other such that the inner passages of the two passage portions 146, 165 are interconnected. Here, the guide passage portion 165 is joined to pass through the fuel pump plate 110 and the bottom of the housing 161 of the pump control unit 160. The upper end of the guide passage portion 165 may be joined to the pump control unit 160, and the guide passage portion 165 may be formed to extend long upwards from the bottom of the housing, even inside the housing 161 of the pump control unit 160.

The pump control unit 160 receives a flow rate signal representing a fuel flow rate required for the engine from an engine control unit (not shown), and controls the driving speed (rpm) of the fuel pump 120 in response to the received flow rate signal. In this process, the pump control unit 160 drives the pump motor of the fuel pump 120 and outputs a PWM (pulse width modulation) signal for controlling the rotation speed thereof.

In an embodiment of the present disclosure, the housing 161 of the pump control unit 160 may be provided in a plate-integrated structure that is integrally fixed to the outer surface (the upper surface) of the fuel pump plate 110 via the guide passage portion 165. Here, as described above, the guide passage portion 165 is formed to extend long upwards from the bottom of the housing 161, even inside the housing 161 through the bottom of the housing 161 of the pump control unit 160.

Also, the inner space of the housing 161 of the pump control unit 160 is provided with a printed circuit board (PCB) 164 and a solenoid (coil) 151 of the solenoid valve, which is the recovery control valve 150. Also, a cover 163 constituting the housing 161 of the pump control unit 160 is installed on the upper surface of the housing body 162, and a guide pin 156 may be fixed to be disposed vertically downwards from the inner surface of the cover 163.

Also, the plunger 152 is slidably joined to the outer periphery of the guide pin 156 in the axial direction (the up and down direction in the drawing), and the plunger 152 is assembled to be disposed along the inner passages of the connection passage portion 146 and the guide passage portion 165. Here, the upper portion of the plunger 152 may be disposed in the vicinity of the solenoid 151, and specifically, may be disposed below the solenoid 151, or may be disposed to pass through the solenoid 151.

Also, a return spring 155 for elastically supporting the plunger 152 is installed inside the guide passage portion 165, and the return spring 155 provides elastic restoring force for returning the plunger 152 downwards. Accordingly, the recovery control valve 150 becomes a normal close valve that maintains a closed state when power is turned off.

The solenoid 151 of the recovery control valve 150 is connected to the vehicle battery through a driving circuit unit (not shown), and the driving circuit unit is provided to selectively apply or not apply the current of the battery to the solenoid 151 in response to the control signal output by the pump control unit 160.

Figure 8:
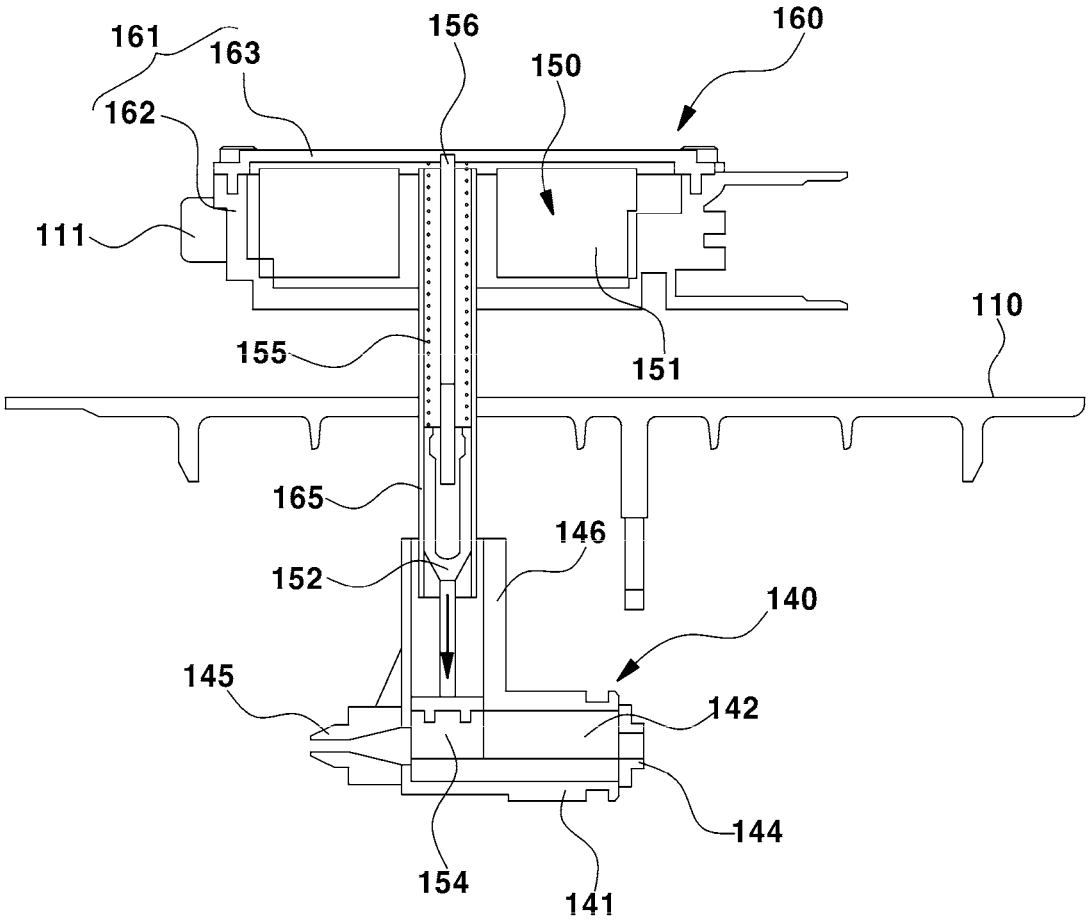
FIG. 8 illustrates the state of operation of the recovery control valve in a closed state according to an embodiment of the disclosure.
Figure 9:
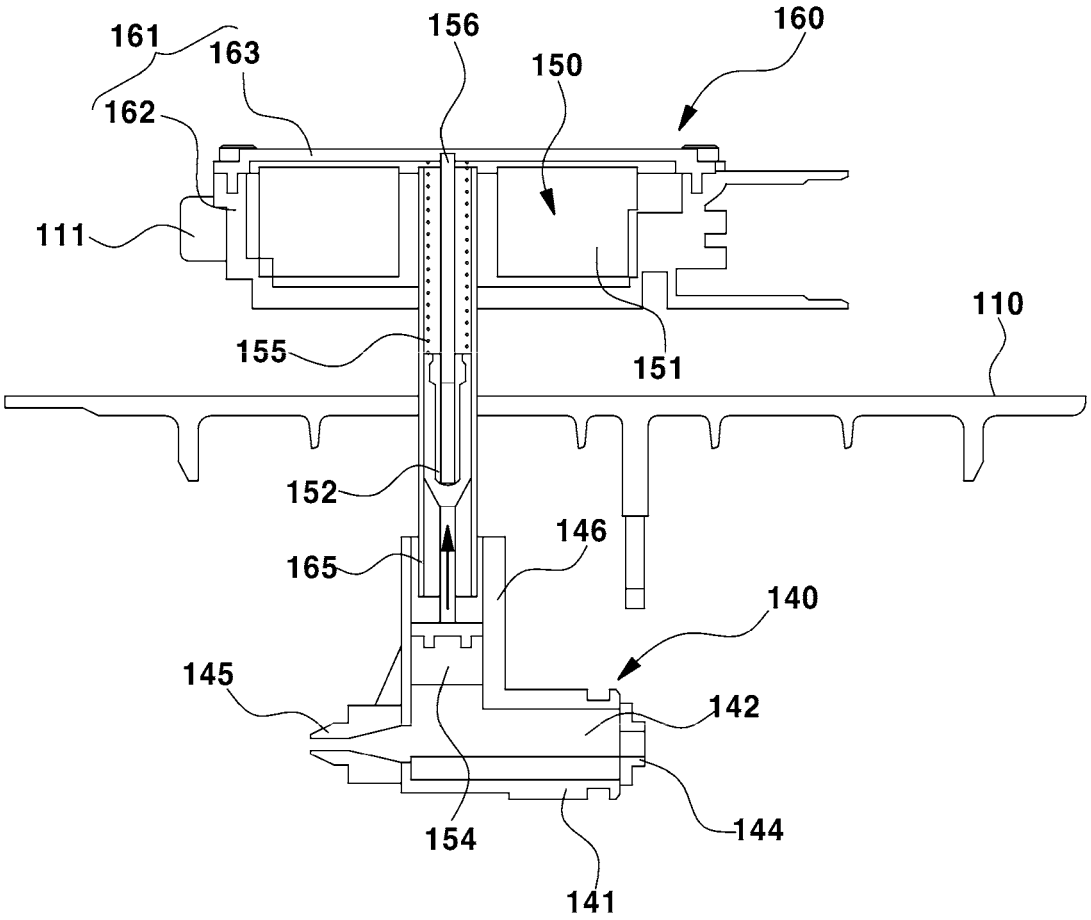
FIG. 9 illustrates the state of operation of the recovery control valve in an open state according to an embodiment of the disclosure.

FIGS. 8 and 9 show the state of operation of the recovery control valve 150. FIG. 8 shows the recovery control valve 150 in a closed state, and FIG. 9 shows the recovery control valve 150 in an open state. When the recovery control valve 150 is closed, the ejector 140 enters an off state and does not operate, and negative pressure, which is a purge power source, is not generated inside the ejector 140, so the fuel evaporation gas in the canister is not sucked into the ejector 140.

On the other hand, when the recovery control valve 150 is opened, the ejector 140 enters an on state and operates, and negative pressure, which is a purge power source, is generated inside the ejector 140, so the fuel evaporation gas in the canister may be sucked into the ejector 140.

More specifically, when the pump control unit 160 outputs a control signal for maintaining the recovery control valve 150 in an open state to supply the fuel, which is the driving fluid, to the ejector 140, the driving circuit unit performs control so that the current of the battery is applied to the solenoid 151 in response to this control signal.

Accordingly, the solenoid 151 is electrically charged, and electromagnetic force is generated in the solenoid thereby pulling the plunger 152 upwards in the drawing. Ultimately, the plunger 152 is pulled upwards by the electromagnetic force and ascends while exceeding the force of the return spring 155. Accordingly, the inner passage of the inlet 143 and the inner passage (fuel passage) 142 of the ejector 140 are opened by the valve body 154.

Here, the ejector 140 operates while the fuel delivered by the fuel pump 120 is supplied to the inner passage 142 of the ejector 140. Negative pressure is generated in the inner passage of the ejector 140 while the fuel passes at a high speed. Ultimately, the fuel evaporation gas adsorbed in the canister 10 is sucked into the inner passage 142 of the ejector 140 through the recovery port 10*d*, the recovery line 17, the suction port 112, the suction hose 123, the check valve 124, and the suction inlet 144.

Also, the fuel evaporation gas sucked into the ejector 140 passes through the inner passage 142 of the ejector 140 together with the fuel as the driving fluid, and is discharged and recovered into the fuel tank 1 via the nozzle 145 of the ejector 140. In this way, the ejector 140 acts as a kind of jet pump in a manner in which the fuel evaporation gas is sucked from the outside and is then transferred to the inside of the fuel tank 1, in addition to generation of negative pressure therein using the fuel delivered by the fuel pump 120 as the driving fluid.

On the other hand, when the pump control unit 160 outputs a control signal for closing the recovery control valve 150 so that the fuel, which is the driving fluid, is not supplied to the ejector 140, the driving circuit unit performs control so that the current of the battery is not applied to the solenoid 151 in response to this control signal. Accordingly, the solenoid 151 is not electrically charged, and thus the plunger 152 descends downwards due to the elastic restoring force of the return spring 155.

When the plunger 152 descends in this way, the valve body 154 closes the fuel passage of the ejector 140. Even when the fuel pump 120 is operated, the fuel delivered by the fuel pump 120 is not supplied to the inner passage 142 of the ejector 140, so the ejector 140 does not operate, and the fuel evaporation gas adsorbed in the canister 10 is not sucked into the ejector 140.

The configuration of the sub-purge system newly added in the fuel evaporation gas treatment system according to the embodiment of the present disclosure is specified above. Hereinafter, the control and operation of the sub-purge system are described in more detail.

Figure 10:
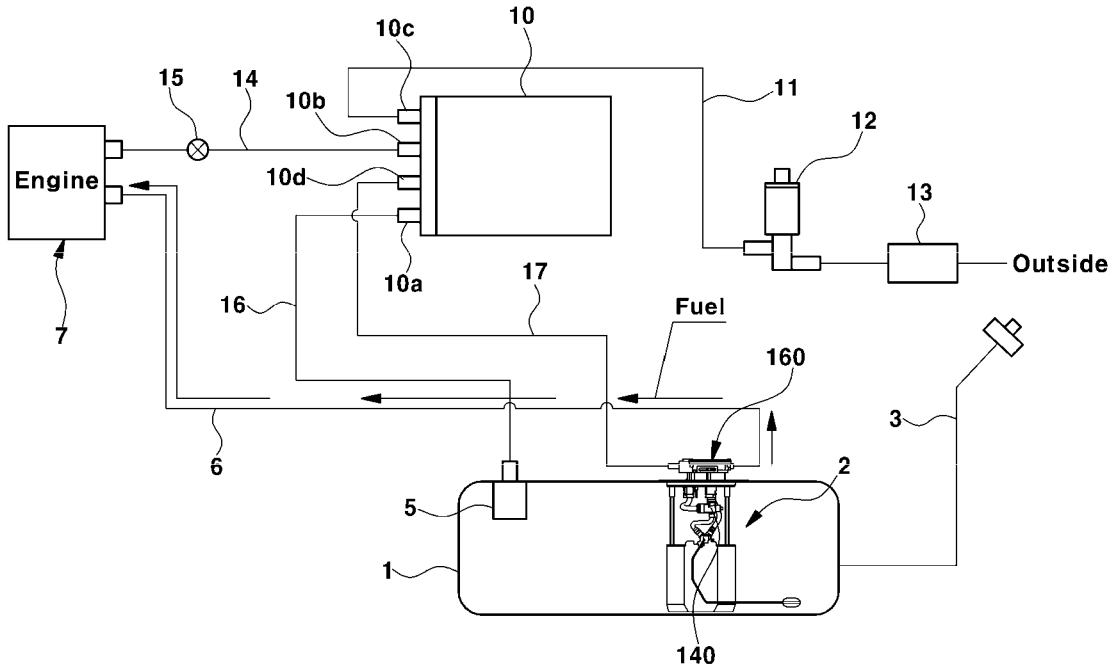
FIG. 10 illustrates a fuel supply state and a purge operation state in the fuel evaporation gas treatment system in which the turbocharger is not operated according to an embodiment of the disclosure.
Figure 11:
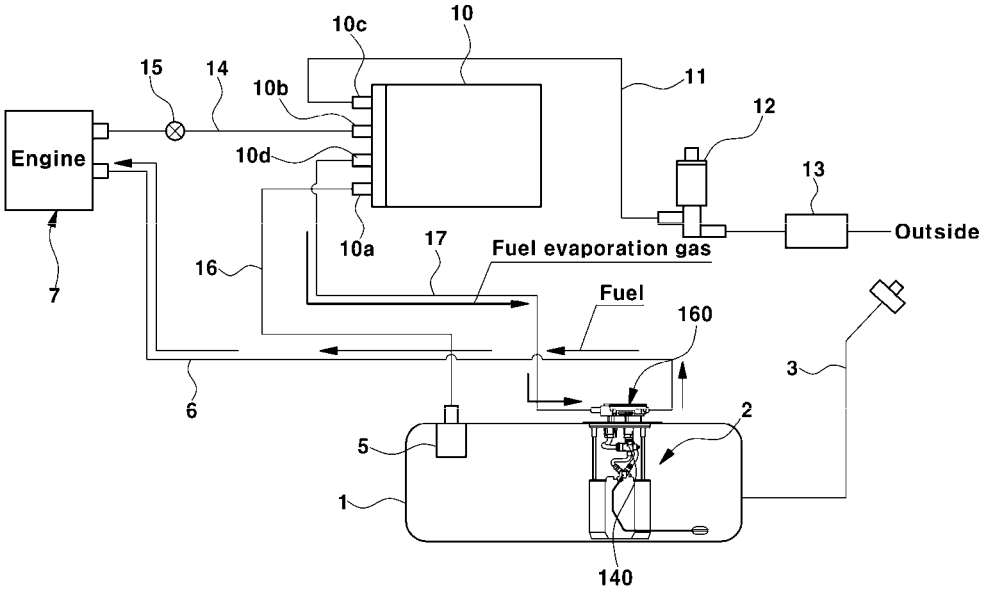
FIG. 11 illustrates a fuel supply state and a purge operation state in the fuel evaporation gas treatment system in which the turbocharger is operated according to an embodiment of the disclosure.

FIGS. 10 and 11 show a fuel supply state and a purge operation state depending on whether or not a turbocharger is operated in the fuel evaporation gas treatment system according to an embodiment of the present disclosure. FIG. 10 shows the turbocharger which is not operated and FIG. 11 shows the turbocharger which is operated.

Figure 12:
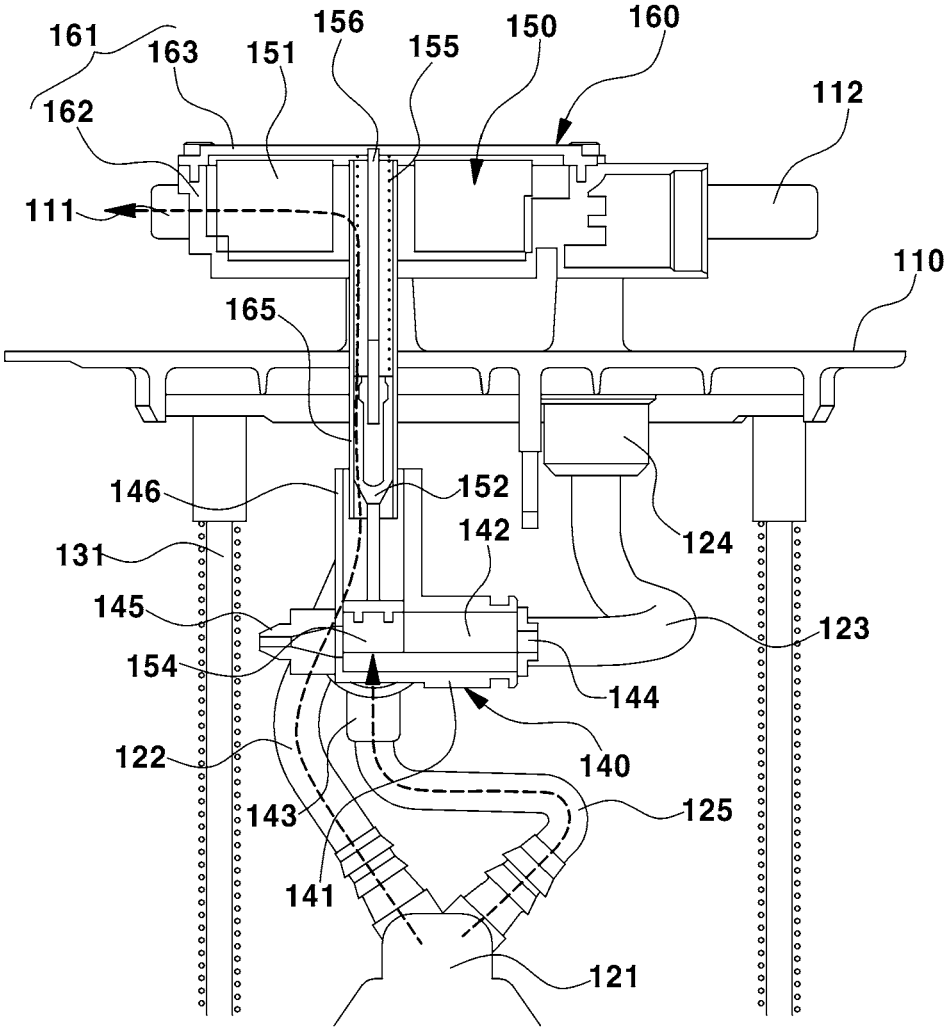
FIG. 12 illustrates the state of movement of fuel discharged from a fuel pump in the fuel evaporation gas treatment system in which the turbocharger is not operated according to an embodiment of the disclosure.
Figure 13:
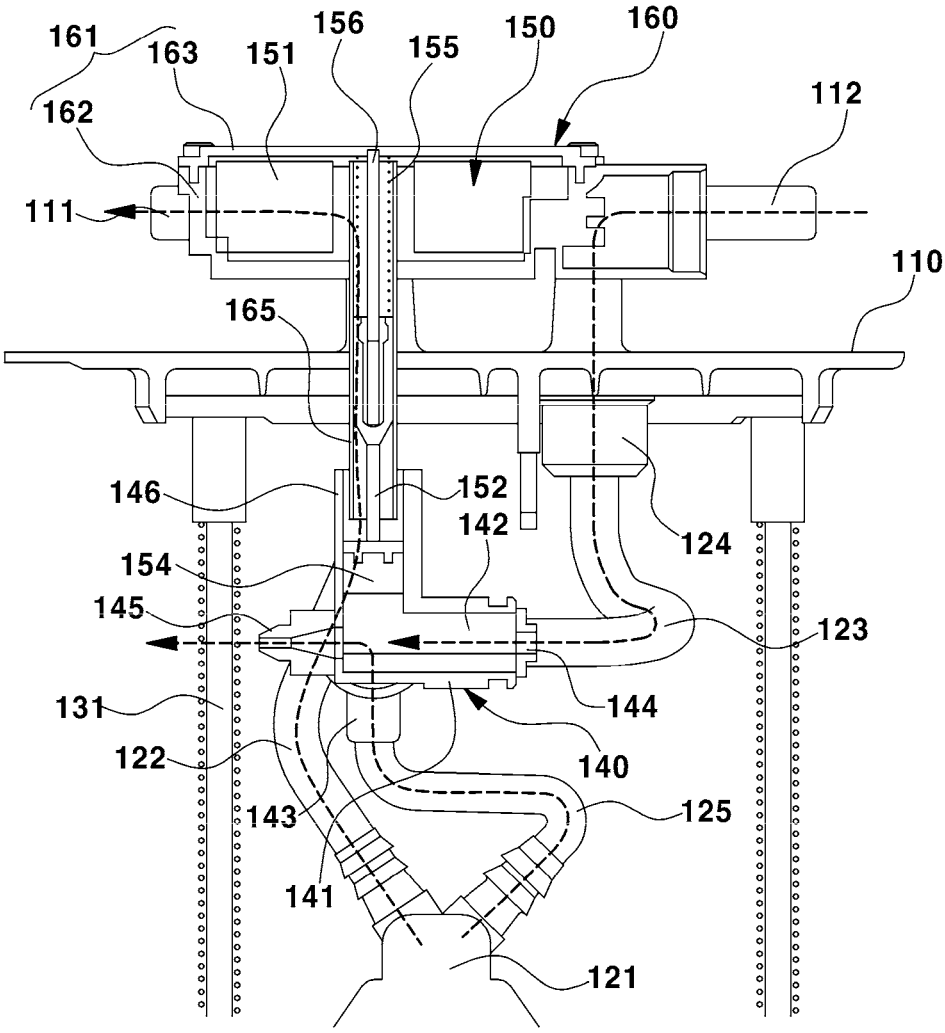
FIG. 13 illustrates the state of movement of fuel discharged from a fuel pump in the fuel evaporation gas treatment system in which the turbocharger is operated according to an embodiment of the disclosure.

Also, FIGS. 12 and 13 show the state of movement of the fuel discharged from the fuel pump 120 through the 3-way connector 121 in the fuel evaporation gas treatment system according to an embodiment of the present disclosure, FIG. 12 showing the turbocharger which is not operated and FIG. 13 showing the turbocharger which is operated.

Figure 14:
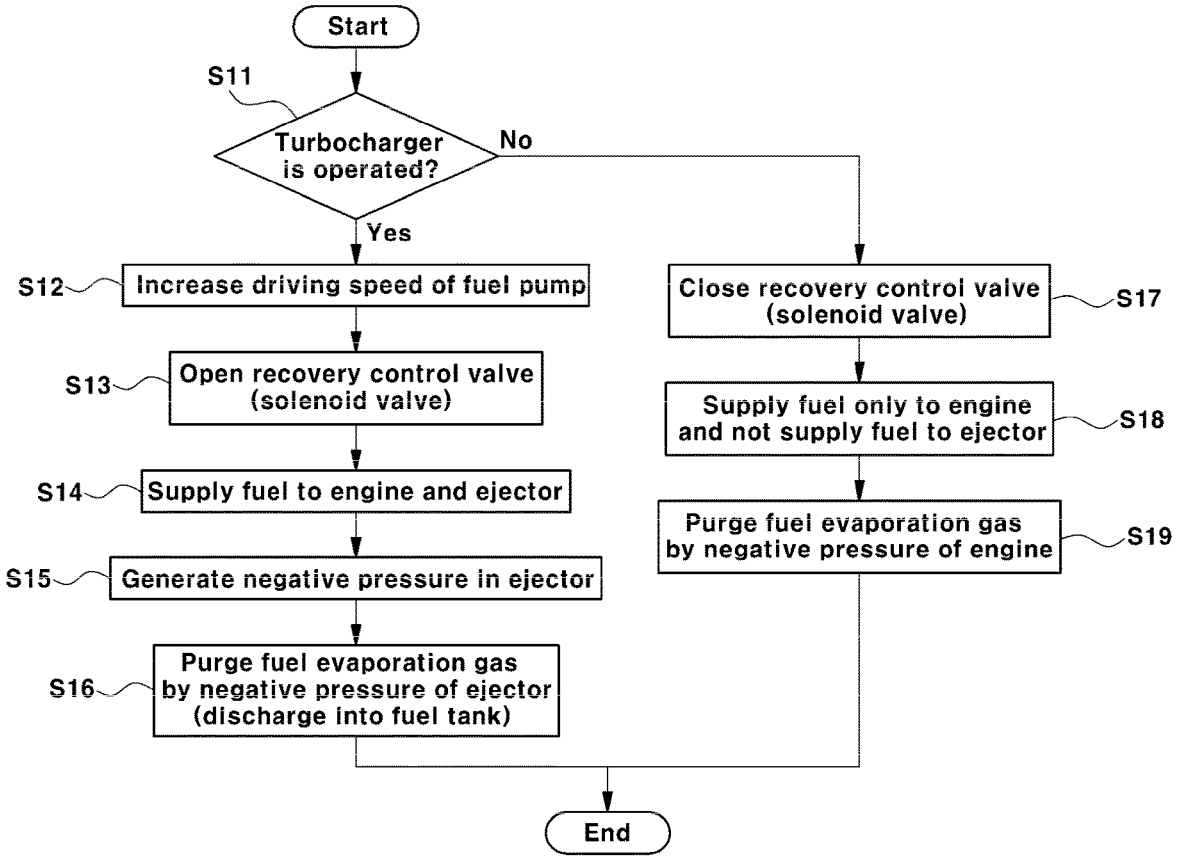
FIG. 14 is a flowchart showing a process for a purge operation of the fuel evaporation gas treatment system according to an embodiment of the present disclosure.

Also, FIG. 14 is a flowchart showing a purge operation process in the fuel evaporation gas treatment system according to an embodiment of the present disclosure. With reference to FIGS. 2 and 10 to 14, the fuel supply state, the purge operation state, and the purge operation process depending on whether or not the turbocharger is operated are described below.

First, when predetermined conditions for operation of the turbocharger are satisfied, the engine control unit initiates control for operation of the turbocharger, and simultaneously transmits a turbocharger operation signal to the pump control unit 160. Also, a flow rate signal representing a fuel flow rate required for the engine while the engine is running is generated and output from the engine control unit. Accordingly, the pump control unit 160 receives the turbocharger operation signal and the flow rate signal.

Then, the pump control unit 160 increases the duty value of the PWM signal for driving the pump motor by a predetermined amount in consideration of the rate at which fuel is to be supplied to the ejector 140, in addition to the fuel flow rate required for the engine 7 during operation of the turbocharger. In the state of running of the engine in which the turbocharger is operated, fuel must be supplied both to the engine 7 and to the ejector 140, so the duty value of the PWM signal for driving the pump motor is increased. Accordingly, the driving speed (rpm) of the fuel pump 120 increases compared to when the turbocharger is not operated, and ultimately, the fuel may be supplied at a flow rate obtained by combining the fuel flow rate required for the engine 7 and the predetermined rate at which fuel is to be supplied to the ejector 140, by the fuel pump 120 (S11, S12).

Also, in the state of operation of the turbocharger, the pump control unit 160 performs control so that the recovery control valve 150 is opened (S13). Specifically, the solenoid valve, which is the recovery control valve 150, is turned on, and the pump control unit 160 generates and outputs a control signal for applying current to the solenoid 151. When the current is applied to the solenoid 151 in this way, the plunger 152 of the solenoid valve is pulled upwards by the electromagnetic force of the solenoid 151 and ascends. As such, the inner passage of the inlet 143 and the inner passage (fuel passage) of the ejector 140 are opened while the valve body 154 ascends.

When the solenoid valve, which is the recovery control valve 150, is opened in this way, some of the fuel delivered by the fuel pump 120 is supplied as a driving fluid to the ejector 140, so the ejector 140 is operated. As such, the remaining fuel except for some fuel supplied to the ejector 140, among the fuel delivered by the fuel pump 120, is supplied to the engine 7, and the fuel is simultaneously supplied to the engine 7 and the ejector 140 by the fuel pump 120 (S14).

When the ejector 140 is operated in this way, the sub-purge system is operated. Specifically, while the fuel supplied as a driving fluid by the fuel pump 120 passes through the inner passage 142 of the ejector 140 at a high speed, the negative pressure serving as the purge power source is generated in the inner passage 142 of the ejector 140 (S15), and the fuel evaporation gas collected in the canister 10 may be sucked into the inner passage 142 of the ejector 140 by this negative pressure. The fuel evaporation gas thus sucked moves toward the nozzle 145 together with the fuel in the inner passage 142 of the ejector 140, and is then discharged into the fuel tank 1 through the nozzle (S16).

In the state in which the turbocharger is operated, the fuel evaporation gas in the canister 10 is sucked by the negative pressure of the ejector 140 and is then purged to the inside of the fuel tank 1, so conventional problems in which the fuel evaporation gas exceeding the collection capacity of the canister is released outside the vehicle may be solved. Moreover, problems such as failure to satisfy vehicle evaporation gas regulations and generation of a fuel smell may be solved.

Meanwhile, in the state of running of the engine in which the turbocharger is not operated, the driving speed (rpm) of the fuel pump 120 is controlled by the pump control unit 160 to supply only the fuel flow rate required for the engine based on the flow rate signal received from the engine control unit.

Also, in the state in which the turbocharger is not operated, the pump control unit 160 performs control so that the recovery control valve 150 is closed. Specifically, the solenoid valve, which is the recovery control valve 150, is controlled in an off state (S17). When the solenoid valve is controlled in the off state in this way, the fuel serving as the driving fluid is not supplied to the ejector 140, and negative pressure is not generated inside the ejector 140 (S18). Moreover, because the ejector 140 is not operating, the purge power source at this time is the engine negative pressure, and the fuel evaporation gas collected in the canister 10 is sucked into the engine 7 by the engine negative pressure and is then burned (S19).

As described above, according to the fuel system of the present disclosure, even when the turbocharger is operated, the fuel evaporation gas collected in the canister may be sucked by the negative pressure generated in the ejector and purged into the fuel tank, ultimately satisfying vehicle evaporation gas regulations as well as solving problems related to the generation of a fuel smell.

Moreover, since the fuel is ejected at a high pressure into the fuel tank using the ejector, vaporization of the fuel may be induced in the fuel tank. Specifically, the fuel ejected into the fuel tank may be vaporized, whereby, when the temperature and pressure in the fuel tank are high, an effect of decreasing the temperature and pressure due to latent heat of evaporation may be expected.

As is apparent from the above description, in the fuel evaporation gas treatment system according to the present disclosure, the fuel evaporation gas collected in the canister is sucked by the ejector during operation of the turbocharger and is recovered into the fuel tank, thereby solving conventional problems such as failure to satisfy evaporation gas regulations and generation of a fuel smell due to the inability to purge a fuel evaporation gas.

The present disclosure has been described in detail with reference to preferred embodiments thereof. However, it will be appreciated by those skilled in the art that changes may be made in these embodiments without departing from the principles or spirit of the present disclosure, the scope of which is defined in the appended claims and their equivalents.

What is claimed is:

1. A fuel evaporation gas treatment system comprising a sub-purge system configured such that a fuel evaporation gas adsorbed in a canister is recovered into a fuel tank, wherein the sub-purge system comprises:

a recovery port formed in the canister;

a fuel pump plate mounted over an opening in the fuel tank, the fuel pump plate having a first side and a second side opposite the first side;

a recovery line connected to the recovery port;

an ejector positioned on the first side of the fuel pump plate, wherein the ejector is provided to receive a fuel delivered by a fuel pump as a driving fluid, to suck a fuel evaporation gas collected in the canister through the recovery line and the recovery port when negative pressure is generated by the driving fluid, and to discharge the fuel evaporation gas to the fuel tank;

a driving fluid hose configured to connect a discharge port of the fuel pump to a driving inlet of the ejector to supply the fuel delivered by the fuel pump as the driving fluid to the ejector;

a pump control unit; and a recovery control valve positioned on the second side of the fuel pump plate, wherein the recovery control valve is configured such that the driving fluid delivered along the driving fluid hose by the fuel pump is selectively supplied to an inner passage of the ejector in response to a control signal of the pump control unit, wherein the pump control unit is configured to control operation of the recovery control valve so that the fuel delivered by the fuel pump is supplied to the ejector via the negative pressure of the ejector when a turbocharger is operated and the fuel is not supplied to the ejector and negative pressure is not generated by the ejector when the turbocharger is not operated.

2. The fuel evaporation gas treatment system of claim 1, wherein a fuel hose for supply of the fuel to an engine and the driving fluid hose are connected to the discharge port of the fuel pump, so a portion of the fuel discharged through the discharge port of the fuel pump is supplied to the engine through the fuel hose, and a remainder of the discharged fuel is supplied to the ejector through the driving fluid hose.

3. The fuel evaporation gas treatment system of claim 2, wherein:

an inlet of a 3-way connector is connected to the discharge port of the fuel pump, the fuel hose is connected to one of two outlets of the 3-way connector, and the driving fluid hose is connected to a remaining one of the two outlets of the 3-way connector.

4. The fuel evaporation gas treatment system of claim 1, wherein the ejector is installed in the fuel tank.

5. The fuel evaporation gas treatment system of claim 1, wherein the pump control unit is configured to control a driving speed of the fuel pump so that a predetermined rate at which fuel is to be supplied to the ejector is further supplied, in addition to a fuel flow rate required for an engine when the turbocharger is operated.

6. The fuel evaporation gas treatment system of claim 1, wherein a suction inlet of the ejector is connected to the recovery line via a suction hose.

7. The fuel evaporation gas treatment system of claim 6, wherein the suction hose is provided with a check valve to prevent fuel supplied to the ejector by the fuel pump from flowing to the canister through the suction hose and the recovery line and to enable only the fuel evaporation gas in the canister to be sucked into the ejector.

8. The fuel evaporation gas treatment system of claim 7, wherein a suction port is installed on an outer surface of a fuel pump plate, which is mounted over an opening in the fuel tank, so the recovery line is connected to the suction port and the check valve is installed between the suction port and the suction hose.

9. The fuel evaporation gas treatment system of claim 1, wherein the recovery control valve comprises:

a solenoid;

a guide passage portion installed to pass through the fuel pump plate;

a guide pin fixedly installed in the guide passage portion;

a plunger joined to the guide pin in the guide passage portion to be movable back and forth, and configured to move back and forth by controlling current supply to the solenoid and interruption of the current supply;

a valve body installed at an end of the plunger inserted into the ejector to open and close the fuel passage of the ejector when the plunger moves back and forth; and a return spring installed to elastically support the plunger and configured to return the plunger moved by the solenoid.

10. The fuel evaporation gas treatment system of claim 9, wherein a connection passage portion is formed to extend in a predetermined direction on a housing of the ejector, the guide pin and the plunger are disposed inside the guide passage portion and the connection passage portion in a state in which the guide passage portion and the connection passage portion of the ejector are connected, and an end of the plunger is inserted into the housing of the ejector.

11. The fuel evaporation gas treatment system of claim 9, wherein the solenoid is installed in the pump control unit provided to the fuel pump plate to control driving of the fuel pump, and is provided such that current supply and interruption of the current supply are controlled by the pump control unit.

12. The fuel evaporation gas treatment system of claim 11, wherein the pump control unit is configured to control a driving speed of the fuel pump so that a predetermined rate at which fuel is to be supplied to the ejector is further supplied, in addition to a fuel flow rate required for an engine when the turbocharger is operated.

13. A fuel evaporation gas treatment system comprising a sub-purge system configured such that a fuel evaporation gas adsorbed in a canister is recovered into a fuel tank, wherein the sub-purge system comprises:

a recovery port formed in the canister;

a fuel pump plate mounted over an opening in the fuel tank, the fuel pump plate having a first side and a second side opposite the first side;

a recovery line connected to the recovery port;

an ejector positioned on the first side of the fuel pump plate, wherein the ejector is provided to receive a fuel delivered by a fuel pump as a driving fluid, to suck a fuel evaporation gas collected in the canister through the recovery line and the recovery port when negative pressure is generated by the driving fluid, and to discharge the fuel evaporation gas to the fuel tank;

a driving fluid hose configured to connect a discharge port of the fuel pump to a driving inlet of the ejector to supply the fuel delivered by the fuel pump as the driving fluid to the ejector; and a recovery control valve positioned on the second side of the fuel pump plate, wherein the recovery control valve is configured to open and close the driving inlet and an inner passage of the ejector using a valve body integrally installed to a plunger by moving the plunger back and forth in response to a control signal of a pump control unit, wherein the pump control unit is configured to control operation of the recovery control valve so that the fuel delivered by the fuel pump is supplied to the ejector via the negative pressure of the ejector when a turbocharger is operated and the fuel is not supplied to the ejector and negative pressure is not generated by the ejector when the turbocharger is not operated.

* * * * *